United States Patent [19]

Johnson et al.

[11] Patent Number: 4,999,966

[45] Date of Patent: Mar. 19, 1991

[54] METHOD OF FORMING AN-BEFORE "IMMURED"

[75] Inventors: Mark S. Johnson; Gordon T. French, Jr., both of Houston, Tex.

[73] Assignee: Houston Industries Incorporated, Houston, Tex.

[21] Appl. No.: 310,379

[22] Filed: Feb. 15, 1989

Related U.S. Application Data

[62] Division of Ser. No. 221,082, Jul. 19, 1988, abandoned.

[51] Int. Cl.[5] ..... E04G 21/00

[52] U.S. Cl. ..... 52/742

[58] Field of Search ..... 52/165, 166, 169.13, 52/295, 296, 170, 742; 405/239; 256/19; 264/35

[56] References Cited

U.S. PATENT DOCUMENTS

| | | | |
|---|---|---|---|
| 2,612,024 | 9/1952 | Hunsucker . | |
| 3,197,964 | 8/1965 | Fehlman . | |
| 3,544,110 | 12/1970 | Dickinson . | |
| 3,555,751 | 1/1971 | Thorgusen | 52/742 |
| 3,685,232 | 8/1972 | Steffen . | |
| 3,991,532 | 12/1976 | Buxbom . | |
| 4,104,868 | 8/1978 | Jackson . | |
| 4,179,861 | 12/1978 | Brown . | |
| 4,242,851 | 1/1981 | Pohlman . | |
| 4,272,929 | 6/1981 | Hanson . | |
| 4,617,768 | 10/1986 | Gebelius . | |

*Primary Examiner*—David A. Scherbel
*Assistant Examiner*—Michele A. Van Patten
*Attorney, Agent, or Firm*—Pravel, Gambrell, Hewitt, Kimball & Krieger

[57] ABSTRACT

A foundation for supporting poles, particularly electrical power cable support poles, is formed by boring a hole only slightly larger than the pole base onto the earth a desired depth. A reinforcing structure is lowered into the hole. The reinforcing structure usually rests on the bottom of the hole and extends above the earth surface a number of feet. The hole is then filled with concrete, usually up to the earth surface, and allowed to cure. A lowermost or base section of the pole is then lowered into position about an exposed upper portion of the reinforcing structure. Concrete is placed into the interior of the pole section about the reinforcing structure until it is covered. After the concrete cures, any remaining pole sections may be installed onto the base section.

7 Claims, 2 Drawing Sheets

METHOD OF FORMING AN-BEFORE "IMMURED"

This is a division of application Ser. No. 221,082, filed July 19, 1988, now abandoned.

BACKGROUND OF THE INVENTION

1. FIELD OF THE INVENTION

The present invention relates to the connection of concrete foundations and tubular poles and their installation.

2. DESCRIPTION OF PRIOR ART

Tubular poles have been used in many applications such as electrical transmission and distribution lines, electrical substation structure supports, outdoor lighting poles, and billboard supports. The tubular poles were normally made of steel, but any other suitable material could be used such as aluminum or fiberglass. The poles were normally six, eight or twelve sided and tapered. Round tapered poles were common for smaller diameter poles. In some cases non-tapered poles have been used. The poles have been normally supported by drilled shaft foundations (caissons). There have been, so far as is known, three methods to anchor the poles: anchor bolts, direct embedment and direct burial. With anchor bolt foundations, a reinforcing bar cage was installed, and encased within a drilled bore hole which was then filled with concrete. A group of long steel bolts joined by a setting template were stabbed into the fresh concrete before the concrete had set. Once the concrete had set the bolts projected out of the concrete and fitted through a steel baseplate welded or bolted to the bottom of the pole. The number of bolts varied with the size of bolt used and the structural loads on the pole. The anchor bolts were fastened to the baseplate with one or two nuts.

The direct embedded method connected the pole to a drilled shaft foundation by embedding the bottom end of the pole in the concrete foundation. A direct embedded pole was connected to foundation by extending the pole into the foundation normally below ground. The construction of a direct embedded pole required supporting the pole at its desired position in the concrete until the concrete set up.

A direct buried pole did not have a concrete foundation. It was buried along its base portion in a hole augured in the earth. The backfill material used to bury the pole base could be either natural earth or a specially selected backfill material, such as sand, gravel, cement, stabilized sand or concrete. The inability to compact the backfill material at great depths limited its use to lower structural loads than other methods.

Where more than one line circuit was to be supported by a pole, the foundation was required to be of considerably larger diameter than the pole, increasing material costs considerably. Another problem present with anchor bolt foundations and their size was the difficulty of finding a suitable location for them. Personnel were concerned with finding a site for a ten foot or so diameter foundation pole into a right of way already full of buried wires and pipes, as well as ditches, roads, sidewalks and other surface obstructions.

SUMMARY OF THE INVENTION

Briefly, the present invention provides a new and improved foundation for supporting a pole. The present invention is particularly adapted for supporting electrical power cable support poles, although it may equally as well be used with other support poles if desired. A hole only slightly larger in diameter than the cross-sectional area of a base member of the pole is bored into the earth to a desired depth at the pole site. A support structure, which may be one or more cages formed of a plurality of reinforcing bars or other concrete reinforcing structure, such as prestressing tendons or structural steel shapes, is then lowered into the hole. With the present invention, an upper portion of the support structure extends above ground level a distance of several or more feet, depending on the size and height of the pole being installed.

The hole is then filled to the required elevation, normally ground level, about the reinforcing bar cage with concrete, which is then allowed to set. After the concrete has set and cured, a base member of the pole is then lowered over the upper portion of the support structure. Once the pole base member has been trued to a vertical position and supported or guyed into such a position, another portion of the concrete is placed into the pole base member about the upper portion of the support structure. Placing concrete may thereafter continue, if desired, until the desired height of concrete is contained within the pole base member. This second concrete with its reinforcing structure does not extend into the first foundation and does not require additional support while it sets up. Once the second concrete has set or hardened, support for the pole base member maybe removed. The resulting foundation is thus surrounded or immured by the pole. Upper portions of the pole may then be installed, if needed, on the pole base member.

DESCRIPTION OF THE PREFERRED EMBODIMENT

Figure 3:
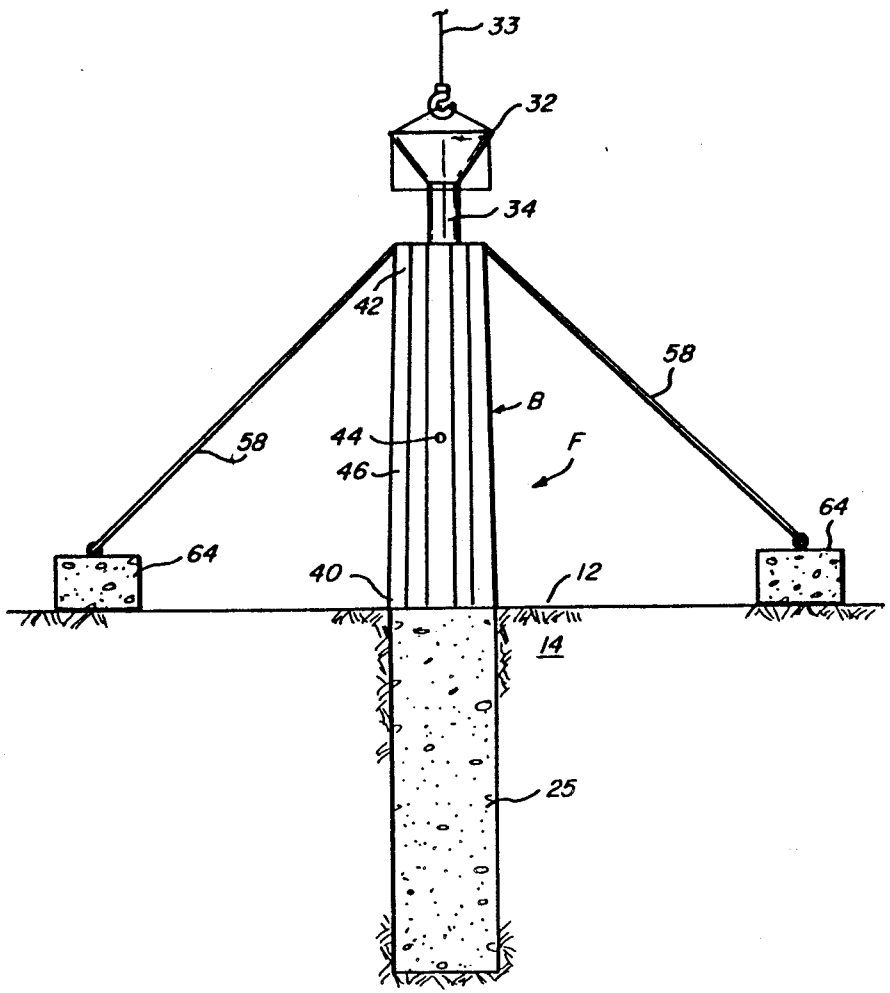
FIGS. 1, 2 and 3 are elevation views, taken partly in cross-section, of a pole foundation according to the present as it is being installed.

In the drawings, the letter F designates generally a foundation for supporting a pole according to the present invention. Although particularly adapted for supporting electrical power, cable support poles, the foundation F of the present invention may equally as well be used with other support poles, if desired.

With the present invention, a hole 10 is drilled downwardly below a grade or ground level 12 in an earthen body 14 a suitable depth, depending upon the height and size of the pole being installed. A typical hole for electrical power cable support poles may be drilled a depth on the order of fifteen or twenty feet. The hole 10 made with the present invention be only slightly larger in diameter than the cross-sectional area of a base member B of the pole. The base member B also serves as a component of the foundation F, as will be set forth.

Figure 4:
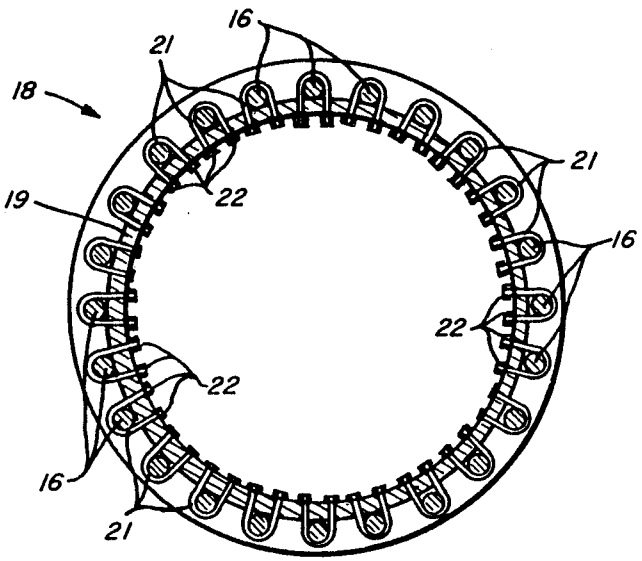
FIG. 4 is an enlarged cross-sectional view taken along the line 4—4 of FIG. 1.

A reinforcing structure, such as one or more cages C, is then inserted into the hole 10. Where more than one cage is used, usually to reduce lifting weight requirements, they are located concentrically and adequately spaced from each other to permit concrete flow between them. The cage or cages C of the foundation F are formed from a plurality of deformed reinforcing bars or rods 16 which are maintained in a cylindrical arrangement (FIG. 4) by a suitable number of collars or templates 18 which are spaced along the longitudinal extent of the cage C. Although deformed reinforcing bars are preferred for the reinforcing structure according to the present invention, any other material normally used to reinforce concrete may be used. Examples include prestressing tendons or structural steel shapes. The collars or templates 18 are in the shape of outwardly facing, cylindrical angle irons having a vertical member 19 and a horizontal plate 20. The templates 18 are mounted at selected positions with the reinforcing bars 16 (FIG. 4) by U-bolts 21, or other suitable attaching mechanisms, which pass through openings in the plates with the templates 18 by lug nuts 22.

Between the templates 18 are mounted a number of smaller circular or spiral support reinforcing bars 23 which are fastened or attached by wires in the conventional manner to the reinforcing bars 16. The templates 18 and bars 23 resist shear forces and help support the bars 18 as the cage C is constructed. The cage C is a generally rigid, cylindrical member having gaps between adjacent vertical reinforcing bars 16 and the circular reinforcing collars 23 or the templates 18, as the case may be. It is important to note that with the present invention the vertical reinforcing bars 16 need not be trued to a precise position by an alignment template with any bolt openings, as was the case with prior art anchor bolt foundations.

The cage C is then connected to a cable extending from a crane or other lifting mechanism at an upper portion 24 and the cage C lifted until it is in an upright position. The cage C is then moved above the hole 10 and a lower portion 26 thereof lowered into the hole 10, usually until it rests on a bottom surface 28 of the hole 10. If subterranean corrosion presents a problem, a base or footing of concrete can first be poured before the cage C is positioned in the hole 10. In position, the upper portion 24 of the cage C extends above the ground level 12 a distance of several or more feet, indicated by an arrow 30, above the grade or ground level 12. The length of the upper portion 24 of the reinforcing structure above the ground level depends on several factors, such as pole base diameter, reinforcement embedment requirements and structural loads. The amount or extent of the upper portion 24 of the cage C above the ground level 12 is generally on the order of one and one-half to three times the diameter of the pole base being installed. Also, usually three inches or so of clearance is present between the upper portion 24 of the cage C and the base member B. Further, the cage C usually extends above the ground level 12 about one-half the height of the base member B and about ten percent of the pole height.

Once the cage C is in the hole 10, it is carefully plumbed and centered and supported in the hole 10 with ropes, wires or chains to prevent movement. Concrete is placed into the hole 10 about the reinforcing bar cage C until the hole 10 has been filled, usually to the ground level 12, by a first concrete portion 25. If it is desired to have the first concrete portion 25 extend slightly above ground level 12, conventional pour forms may be used. The concrete 25 introduced to the hole 10 can be introduced by a bucket 32 suspended from a cable 33 controlled by a crane or other suitable lifting mechanism from which the concrete descends through a tremie 34, as shown in the drawings. Alternatively, the concrete can be pumped into the hole 10 through a concrete supply hose and conventional concrete pump. The upper surface of the concrete portion 25 is then smoothed and levelled to provide a good working surface for installing the pole base member B.

After the concrete in the hole 10 has set or hardened to the ground level 12, the pole base member B of the foundation F is lowered over the upper portion 24 of the cage C. The pole base member B is generally ten percent or more of the height of the pole being installed. It is internally hollow and shown in the drawings as an octagonal member in horizontal cross-section. It should be understood, however, that other shapes of base members may be used, if desired.

The base member B tapers slightly inwardly from a lower portion 40 to an upper portion 42 and is formed of a suitable thickness of weather-resistant steel, or other metal of suitable strength. At least one weep hole or drainage hole 44 is formed in a middle portion 46 of the base member B at a height above the upper portion 24 of the cage member C. Lift eyelets or holes are also formed near the top of upper portion 42 of the base member B so that base member B may be engaged by hooks or lifting members 54 mounted at lower ends of cable 56 so that the base member B may be lifted.

Figure 2:
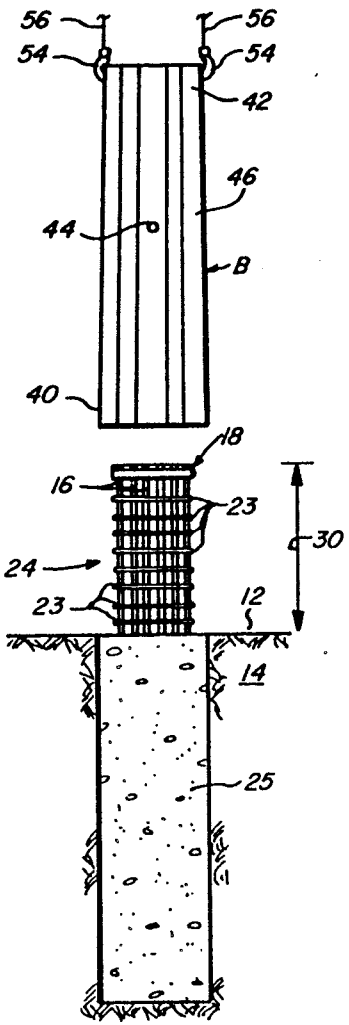
Figure 1:
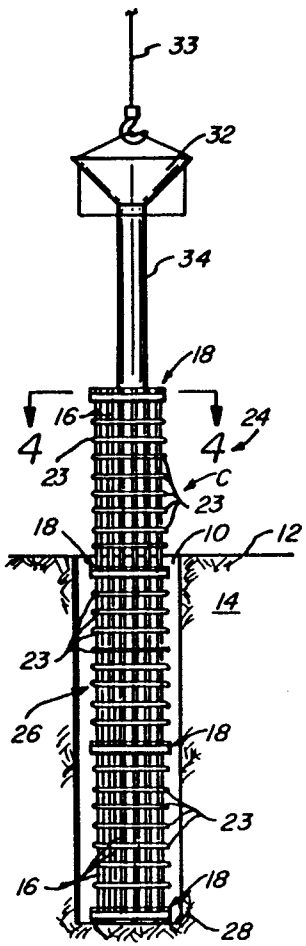

The base member B, once engaged by the lifting members 54, is then lifted and raised by the cables 56 to a vertical position (FIG. 2) above the cage C and lowered into position (FIG. 3) surrounding the upper portion 24 of the cage C extending above the ground level 12. The base member B is then trued to a position where it is maintained, to extend substantially vertically above the ground level 12 using conventional surveying techniques. This is done by attaching temporary guy wires 58 into the lifting holes or eyelets at the upper portion 42 of the base member B and adjusting the position of anchor blocks 64 mounted at opposite ends of the guy wires 58 until the proper vertical position is obtained. With the base member B guyed in this vertical position, it is usually preferable to pack dirt around the lower portion 40 of the base member B for a slight distance to serve as a sealant.

Another portion of concrete is then introduced into the interior of the base member B through the tremie 34 using either the bucket 32, as shown in the drawings, or by means of a conventional concrete supply pump. The concrete placing is continued until portions of it are detected coming out of the weep hole 44, indicating that the level of concrete in the interior of the base member B is at a height, usually about three inches, greater than the upper portion 24 of the reinforcing bar cage C. After such concrete introduction, the base member B may be subjected to slight vibratory motion to insure that adequate compaction of the introduced concrete occurs.

Figure 5:
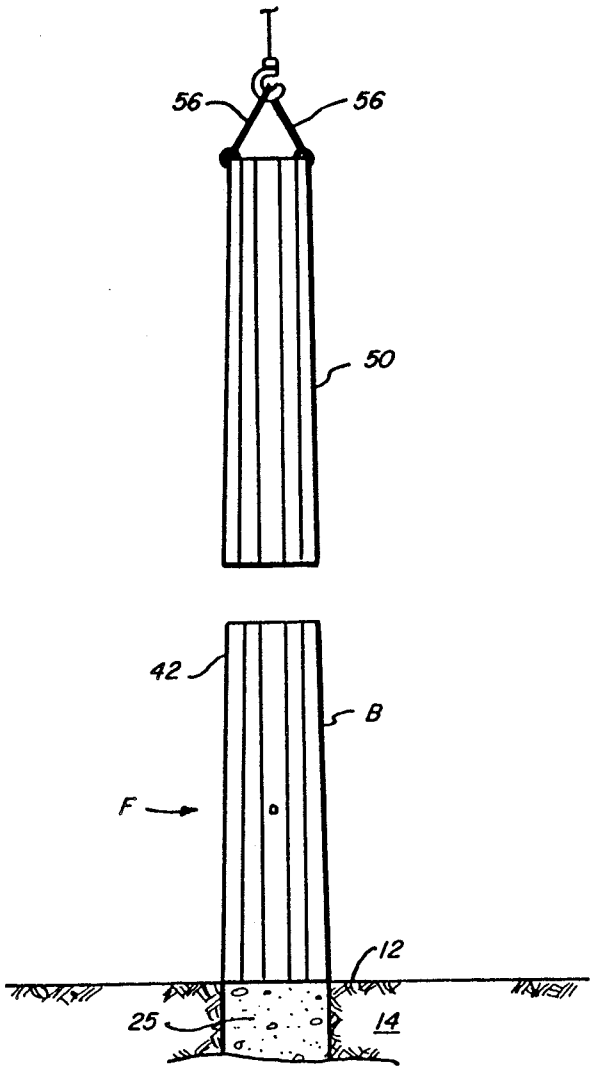
FIG. 5 is an elevation view of an upper pole portion being installed on the foundation of FIG. 3.

The second concrete portion, in the base member B, is then allowed to set or harden. After the setting period has elapsed, the temporary guy wires 56 may then be removed. At this point in time, depending on the desired height of the pole, one or more upper pole sections 50 are then raised into a vertical position (FIG. 5) above the base member B and lowered and telescopingly fitted onto the upper portion 42 of the base member B until resting and being supported on the base member B. The number of additional pole sections telescopingly fitted above the base member B depends upon the desired height and size of the pole to be installed. In some situations, only the base member B may be needed, since it is of a size which can be fabricated, shipped and installed as a single piece.

The foundation F of the present invention can thus be considered immured, as the reinforcing structure is built or entombed into the first and second portions of concrete. The foundation F of the present invention offers significant cost saving features. The base member B and the hole 10 are of substantially the same cross-sectional size, since the concrete 35 below the ground level 12 need only be slightly larger in diameter than the base member B of the pole. This reduces the amount of concrete required for pole foundations. Additionally, there is no need for anchor bolts of the type used in prior anchor bolt foundations, nor is there a need for the setting template which held the anchor bolts in a true vertical position while the concrete was allowed to set. Further, because of the space between the cage C and base member B, there is no need to require precise alignment as was the case with anchor bolts. As another factor, the costly heavy steel base plate used to attach the prior steel poles to the anchor bolts is no longer required.

Another and equally significant advantage of immured foundations according to the present invention is that the reduced diameter required for the hole 10 makes location of pole foundations less difficult in areas where space is at a premium. Examples of this are in rights of way which already have in them buried wires or pipes, or where surface features such as roads, sidewalks, or other obstructions cause problems in location.

With immured foundations, the pole does not extend below ground level, yet it has a concrete foundation to support greater structural loads. The immured foundation is also not subject to below ground corrosion. It should also be understood that although the concrete is preferably placed in the base member B through its top, it could also be placed through the side or bottom depending on concrete pumping capacity.

The immured foundation of the present invention is primarily used to resist structural loads that have large bending moments, axial compression and shear. An advantage of the immured foundation is the fact that the pole can be removed from the foundation by lifting it from the top. When an axial tension load is to be resisted, shear connectors must be placed along the inside wall of the pole to allow axial tension loads to be transferred to the concrete. These connectors could be steel bars or studs welded to the inside of the pole. Other suitable mechanical connectors could also be used. Removal of a pole with shear connectors would then normally require that the pole be cut off of the foundation.

The foregoing disclosure and description of the invention are illustrative and explanatory thereof, and various changes in the size, shape and materials, as well as in the details of the illustrated construction may be made without departing from the spirit of the invention.

We claim:

1. A method of installing an immured foundation for a removable, tubular pole, comprising the steps of:

boring a hole in the ground;

inserting a reinforcing cage into the hole in the ground so that a lower portion of the reinforcing cage rests on the bottom surface of the hole without any means for attaching the reinforcing cage to the bottom surface of the hole and an upper portion of the reinforcing cage extends above ground level;

filling the hole with concrete to ground level about the lower portion of the reinforcing cage;

lowering a removable, tubular separate pole base member over the upper portion of the reinforcing cage onto the hardened concrete; and filling the removable, tubular pole base member with concrete to a level covering the upper portion of the reinforcing cage.

2. The method of claim 1, further including the step of:

truing the removable, tubular pole base member to a vertical position prior to said step of filling the removable, tubular pole base member.

3. The method of claim 2, further including the step of:

maintaining the removable, tubular pole base member in the vertical position during said step of filling the removable, tubular pole base member.

4. The method of claim 1, further including the step of:

mounting at least one upper section of the pole onto the removable, tubular pole base member after the concrete therein has set.

5. The method of claim 1, further including the step of:

vibrating the removable, tubular pole base member after said step of filling the pole base member.

6. The method of claim 1, further including the step of:

truing the reinforcing cage to a vertical position prior to said step of filling the hole with concrete.

7. The method of claim 6, further including the step of:

maintaining the reinforcing cage in the vertical position during said step of filling the hole with concrete.

* * * * *

UNITED STATES PATENT AND TRADEMARK OFFICE

CERTIFICATE OF CORRECTION

PATENT NO. : 4,999,966

DATED : March 19, 1991

INVENTOR(S) : Mark S. Johnson and Gordon T. French, Jr.

It is certified that error appears in the above-identified patent and that said Letters Patent is hereby corrected as shown below:

On the Title Page, Item [54], that portion of the title reading "AN-BEFORE 'IMMURED'" should read -- AN IMMURED FOUNDATION --.

Column 1, lines 2-3, that portion of the title reading "AN-BEFORE 'IMMURED'" should read --AN IMMURED FOUNDATION --.

Column 2, line 38, after the word "present" insert --invention--; Column 2, line 58, after the word "invention" insert --need--.

Signed and Sealed this

Twenty-first Day of June, 1994

Bruce Lehman

*Attest:*

BRUCE LEHMAN

*Attesting Officer*

*Commissioner of Patents and Trademarks*